US005291980A

United States Patent [19]

Abe

[11] Patent Number: 5,291,980

[45] Date of Patent: Mar. 8, 1994

[54] DEVICE FOR SORTING GAME COIN BY PARAMAGNETIC PROPERTIES

[75] Inventor: Hiroshi Abe, Kodaira, Japan

[73] Assignee: Asahi Seiko Co., Ltd., Tokyo, Japan

[21] Appl. No.: 857,786

[22] Filed: Mar. 26, 1992

[30] Foreign Application Priority Data

Mar. 27, 1991 [JP] Japan ..... 3-132411

[51] Int. Cl.[5] ..... G07D 5/08

[52] U.S. Cl. ..... 194/325; 194/214

[58] Field of Search ..... 194/210, 214, 325; 40/27.5

[56] References Cited

U.S. PATENT DOCUMENTS

| | | | |
|---|---|---|---|
| 2,073,260 | 3/1937 | Gottfried | 194/325 |
| 2,528,690 | 11/1950 | Foushee | 194/325 |
| 3,059,748 | 10/1962 | Krysiak | 194/325 |
| 3,559,789 | 2/1971 | Hastie et al. | 194/331 |
| 4,401,488 | 8/1983 | Prinz et al. | 428/675 X |
| 4,579,761 | 4/1986 | Ruscoe et al. | 428/675 X |

*Primary Examiner*—F. J. Bartuska

*Attorney, Agent, or Firm*—Knobbe, Martens, Olson & Bear

[57] ABSTRACT

For sorting input coins by use of their paramagnetic properties, such as a paramagnetic coin, a ferromagnetic coin, and nonmagnetic coin, a device comprises an attracting magnet for attracting the ferromagetic coin by an attracting force of magnetic flux density between 700 and 800 gauss and to allow passage of the paramagnetic coin and the nonmagnetic coin. An incliend rail rolls coins to make coins fly out from a outlet end. A guide magets is disposed on the outlet end and guides the paramagentic coin but the nonmaganetic coin to a under side of the outlet end by attractive force of magnetic flux density between 4000 and 5000 gauss.

4 Claims, 5 Drawing Sheets

DEVICE FOR SORTING GAME COIN BY PARAMAGNETIC PROPERTIES

BACKGROUND OF THE INVENTION:

This invention relates to a coin for use in a game machine, and a coin sorting device. More particularly, this invention relates to a coin having predetermined paramagnetic properties, and a coin sorting device for use in sorting input coins by their features.

A device of the type described, will be referred to herein as a slot machine.

For operating a conventional slot machine, use is generally made of chrome-plated brass coins. In order to discriminate particular game coins for a particular game machine from other coins by means of a sorting device, the particular game coins are made to have a particular diameter and a particular thickness different from those of other coins.

However, with an increased demand for a wide variety of particular game coins, it becomes difficult to meet the demand simply by differing the dimensions of the coins.

In view of the above, many proposals have been made of a game coin consisting of various kinds of material. For example, a coin made of synthetic resin is disclosed in Japanese Utility Model Prepublication No. 110977/1988 by Junichi Hamano. A coin made of a combination of heterogeneous metallic plates in various forms is disclosed in Japanese Patent Prepublications Nos. 10632/1980, 27902/1987 by Haruo Mituwa, Tetsu Nariani et al, and 60323/1989 by Nicora Ierpo.

However, the above-mentioned game coin has less durability than that of conventional homogeneous metal game coins. In addition, the above-mentioned coin can not be sorted by an inexpensive and reliable coin sorting device generally used in a conventional game machine. Therefore, there is a disadvantage in this type of coins wherein a relatively expensive electric sorting device has to be employed.

As prior art relevant to the present invention, Japanese Patent Publication No. 29308/1988 by Hiroshi Abe and Japanese Utility Model Prepublication No. 30143/1987 by Hiroshi Abe disclose means for sorting nonmagnetic coins and ferromagnetic coins as genuine coins and spurious coins, respectively.

SUMMARY OF THE INVENTION

It is therefore an object of the present invention to provide a coin for use in a game machine which is difficult to imitate due to its quality.

It is another object of this invention to provide a coin of the type described, which has an improved durability.

It is sitll another object of this invention to provide a coin of the type described, which is easy to mass produce.

It is yet another object of this invention to provide a coin of the type described, which can be discriminated from spurious coins including nonmagnetic coins and ferromagnetic coins by means of a coin sorting device.

It is still another object of this invention to provide a device for discriminating genuine coins from spurious coins including nonmagnetic coins and ferromagnetic coins.

In accordance with this invention, there is provided a coin for use in a game machine. The coin is composed of nonmagnetic material and ferromagnetic material to impart paramagnetic properties to said coin. And there is provided a device for sorting input coins by their features. The device includes a judging unit for judging whether the input coins fall in a first category or a second category by their paramagnetic properties.

BRIEF DESCRIPTION OF THE DRAWING:

FIG. I is a perspecive view of a device according to an embodiment of this invention.

DESCRIPTION OF THE PREFERRED EMBODIMENTS

Figure 1:
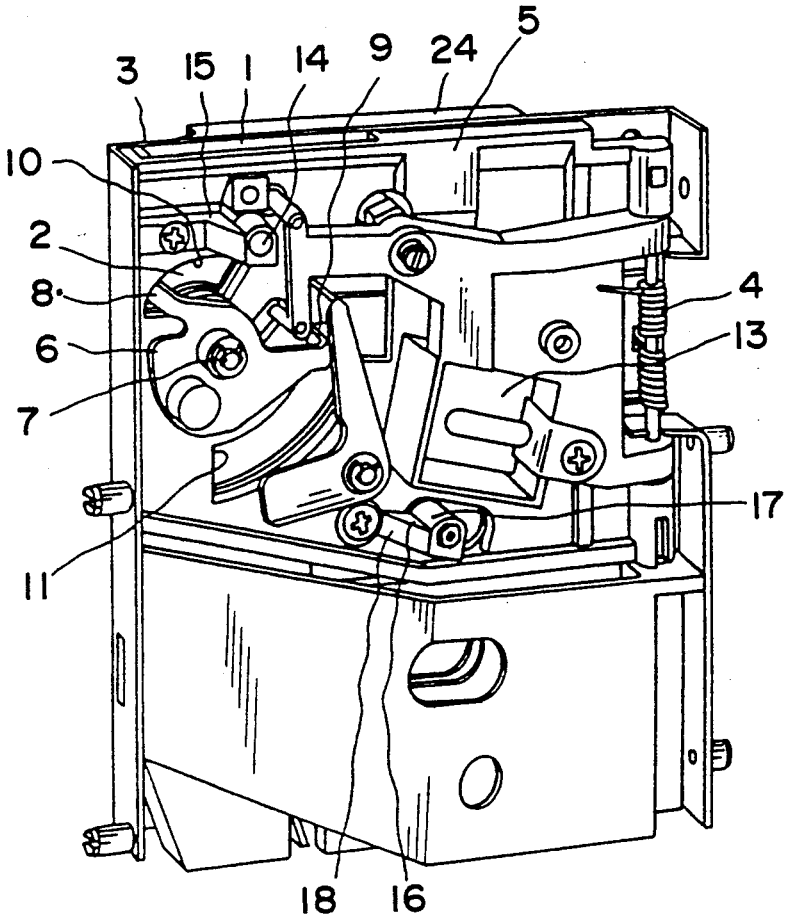
Figure 2:
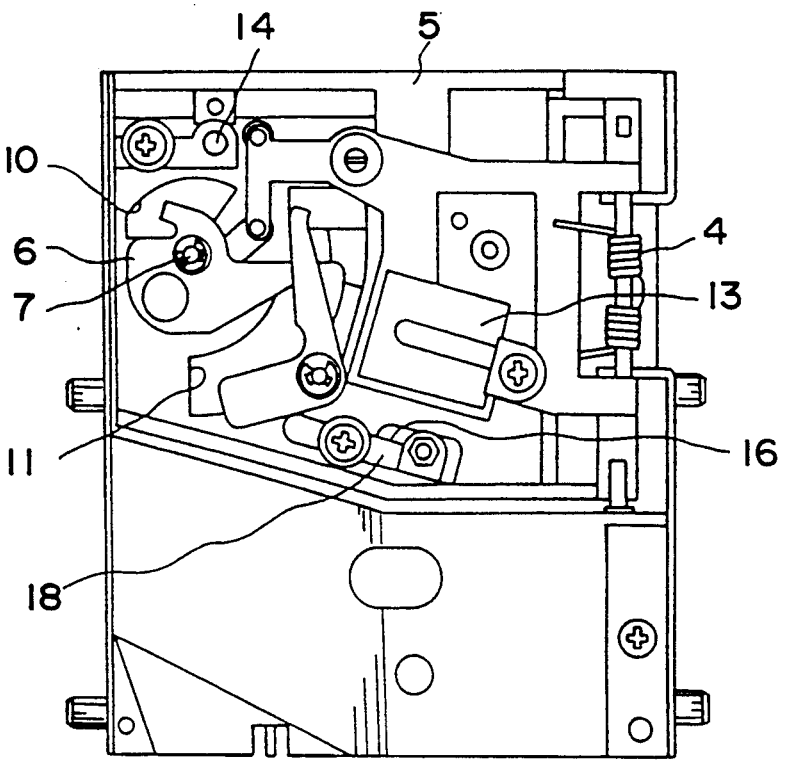
FIG. 2 is a schematic front view of the device depicted in FIG. 1.
Figure 3:
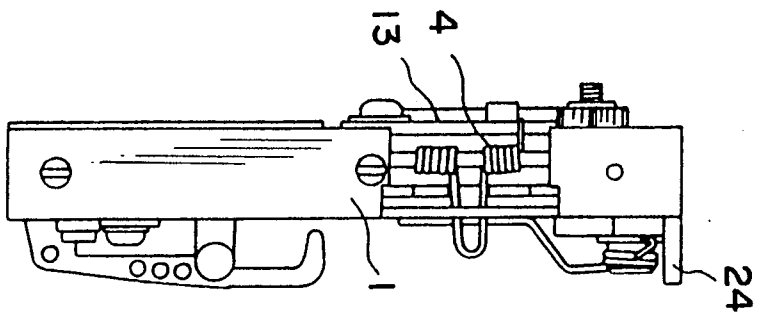
FIG. 3 is a schematic side view of the device depicted in FIG. 1.
Figure 4:
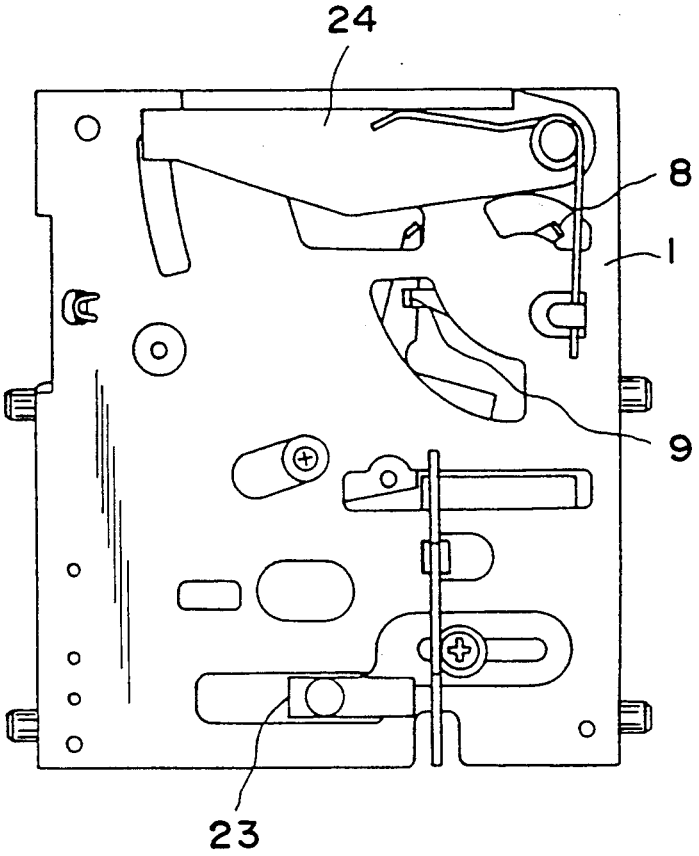
FIG. 4 is a schematic rear view of the device depicted in FIG. 1.

A paramagnetic coin as a game coin according to a first embodiment of this invention has particular paramagnetic properties as a genuine coin. The paramagnetic coin was made from nonmagnetic material and ferromagnetic material by the following method.

Iron fine powder of 3.3–3.5 volume percent, Cu 65 volume percent, and the balance of Zn were prepared. The iron fine powder as the ferromagfnetic material was mixed in hot water solution of brass comprising Cu and Zn as the nonmagnetic material. The nonmagnetic material may include resin, and ceramics.

The hot water solution was electromagnetically agitated to uniformly disperse the iron fine powder in the hot water solution. The reason why content of the iron fine powder is given the upper limit value, of 8 valume percent is that a greater content can not be uniformly mixed, tends to aggregate, and is often combined together to form agglomerates. This results in intense local magnetization by a magnet to cause an effect similar to that of the ferromagnetic material. In addition, the lower limit value is equal to 2 volume percent because the paramagnetic effect is absent whith a smaller value. The solution was solidified into a molded piece which was then rolled into a plate having a thickness of 2.1 mm. After the plate was coined by a press, nickel plating was carried out. Thus, the paramagnetic coins having a diameter of 24.26 mm and weight of 7 g were produced.

In the paramagnetic coin thus produced, the iron powder was uniformly dispersed and mixed in the brass. The game coin exhibited paramagnetic properties such that it can not be attracted by a second magnet having a second magnetic flux density between 700 and 800 gauss but can be attracted by a first magnet having a first magnetic flux density between 4000 and 5000 gauss. Therefore, this paramagnetic coin is not attracted by a ferromagnetic-material attracting magnet having a magnetic flux density between 700 and 800 gauss which can attract a ferromagnetic coin such as an iron coin and a complex coin formed by stacking iron plate and brass plate in a sandwich fashion.

Description will now be made as regards a device according to a second embodiment of the present invention for discriminating the paramagnetic coin from a spurious coin including a nonmagnetic coin or a ferromagnetic coin.

Referring to FIGS. 1-5, an upper inlet 1 is for receiving an input coin inserted through a coin inserting opening ( not shown) formed in a front plate of a game machine. The coin inserting opening has such a dimension that allows insertion of the input coin having a predetermined diameter and width and inhibits insertion of a coin having a larger diameter and width.

An inlet coin passage 2 for dropping the input coin from the coin inserting opening along a generally vertical direction is defined between a stationary side plate 3 and a movable side plate 5 openably connected to the stationary side plate 3 through hinge means 4.

A ferromagnetic-coin attracting magnet 14 which has the second magnetic flux density between 700 and 800 gauss is placed on a side surface of the inlet coin passage 2 at a downstream position of the coin inserting opening. In the illustrated embodiment, the attracting magnet 14 is fitted through a retainer 15 to the movable side plate 5 of the inlet coin passage 2. The attracting magnet 14 has an end surface facing the inlet coin passage 2.

When a ferromagnetic coin as an input coin is dropped into the inlet coin passage 2 through the coin inserting opening, the attracting magnet 14 attracts the ferromagnetic coin and retains the ferromagnetic coin in the inlet coin passage 2. The retained erromagnetic coin is returned by depressing a returning lever 24 in a known manner. On the other hand, when the paramagnetic coin is dropped, the attracting magnet 14 allows passage of the paramagnetic coin.

At a lower portion of the inlet coin passage 2, a diameter/weight sorting cradle 6 is pivoted through a pin 7 to an outer surface of the movable side plate 5. The cradle 6 is provided with engagement lugs 8 and 9. The engagement lugus 8 and 9 are projected through windows 10 and 11 formed in the movable side plate 5 into the inlet coin passage 2, respectively.

The paramagnetic coin having a predetermined diameter of 24.26 mm and weight of 7 g drops through the inlet coin passage 2 and is engaged with both engagement lugs 8 and 9 of the cradle 6 to cause rotation of the cradle 6. Subsequently, the pramgnetic coin is transferred from the cradle 6 onto an inclined rail 12.

The inclined rail 12 has an inlet end and an outlet end to roll the coin from the inlet end to the outlet end with reference running speed so as to make the coin fly out from the outlet end along parabolic travel paths. Then, the coin rolling on the inclined rail 12 traverses a magnetic field to reduce the reference running speed and deflect the parabolic travel paths. The magnetic field is formed by a braking magnet 13 as a running speed reducing magnet secured to the movable side plate 5 and a magnetic path steel plate formed on the stationary side plate 3 at a position opposite to the braking magnet 13. As a result, the travel paths are different between the paramagnetic coin and the nonmaganetic coin since the coins are subjected to magnetic braking force corresponding to their qualities of these coins in a known manner.

The device further includes a guide magnet 17 which is fitted on the outlet end of the inclined rail 12 through a retainer 18 and has an arcuate surface 19. The guide magnet 17 has the first magnetic flux density between 4000 and 5000 gauss.

Figure 5:
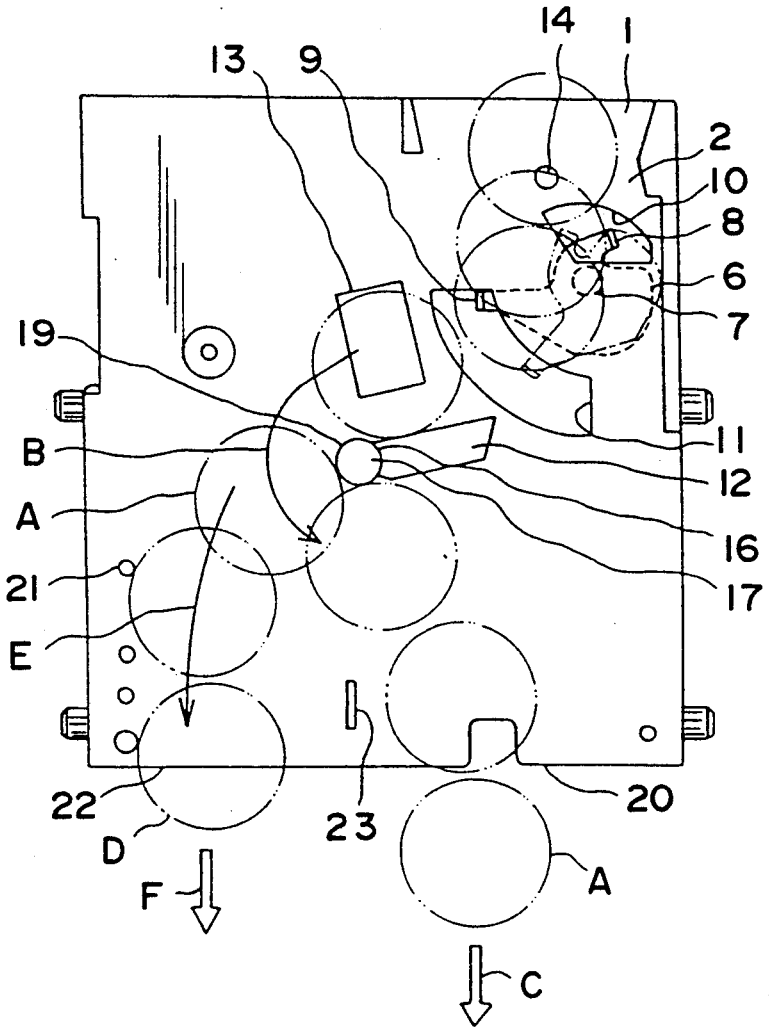
FIG. 5 is a schematic describing operation view of the device depicted in FIG. 1.

Referring FIG. 5, the guide magnet 17 guides the paramagnetic coin A to a lower side of the outlet end along the arcuate surface 19 to make the paramagnetic coin fly out from the lower side of the outlet end. When the paramagnetic coin A is guided by attractive force along the arcuate surface 19, it is deflected as shown by an arrow B. The paramagnetic coin A is guided as a genuine by a guide lug 23 to a genuine acceptance opening 20 disposed under the inclined rail 12 to pass therethrough as shown by an arrow C.

When a nonmagnetic coin D such as a spurious coin made of brass or nickel rolls on the inclined rail 12, the nonmagnetic coin D flies out along a parabolic travel path E without being affected by the attractive force by the guide magnet 17. The nonmagentic coin D collides with a buffering rivet 21 for buffering the movement of the nonmagnetic coin D and passes through a returning opening 22 as shown by an arrow F to be returned in a known manner.

What is claimed is:

1. A device for sorting input coins and selecting a paramagnetic coin having a predetermined size and weight and 2-8 volume percent ferromagnetic material, said device comprising:

a first detector for detecting a ferromagnetic coin having substantially greater amount of said ferromagnetic material than said paramagnetic coin, said first detector rejecting said ferromagnetic coin from said device;

a second detector for detecting an input coin having said predetermined size and weight provided from said first detector, said second detector allowing only input coins having said predetermined size and weight to go down to a next stage of said device;

an inclined rail for receiving said input coin from said second detector at its higher end so that the input coin rolls down on said inclined rail with a predetermined running speed at its lower end of said inclined rail, said inclined rail being arranged so that a nonmagnetic coin rolls down thereon with said running speed and flies out from said lower end along a reference direction to a return outlet of said device;

a third detector for detecting said paramagnetic coin rolling down on said inclined rail and changing direction of said paramagnetic coin to divert said paramagnetic coin into a genuine coin inlet of said device, said third detector being disposed on said inclined rail for deflecting said reference direction by applying magnetic force to said paramagnetic coin in order to distinguish said paramagnetic coin from said nonmagnetic coin, said third detector including a guide magnetic member having a cylindrical surface and is disposed on said lower end of said inclined rail such that it can rotate with said input coin, said guide magnetic member attracting said paramagnetic coin on said cylindrical surface so that said paramagnetic coin rotatably changing direction to fall down to said genuine coin inlet.

2. A device as claimed in claim 1, wherein said guide magnetic member includes a magnet having magnetic flux density between 4000 and 5000 gauss.

3. A device ad claimed in claim 1, wherein said first detector includes a magnetic having magnetic flux density between 700 and 800 gauss.

4. A device as claimed in claim 1, wherein said third detector includes a running speed reducing magnetic member for reducing said running speed of said paramagnetic coin on said inclined rail by providing a magnetic field to said paramagnetic coin.

* * * * *

UNITED STATES PATENT AND TRADEMARK OFFICE

CERTIFICATE OF CORRECTION

PATENT NO. : 5,291,980

DATED : March 8, 1994

INVENTOR(S) : Hiroshi Abe

It is certified that error appears in the above-indentified patent and that said Letters Patent is hereby corrected as shown below:

Claim 3, in column 4, line 60, change "A device ad claimed in claim 1" to --A device as claimed in claim 1--.

Signed and Sealed this

Eleventh Day of October, 1994

*Attest:*

*Attesting Officer*

Bruce Lehman

BRUCE LEHMAN

*Commissioner of Patents and Trademarks*